US005277677A

United States Patent [19]

Terauds

[11] Patent Number: 5,277,677

[45] Date of Patent: Jan. 11, 1994

[54] STEPPING EXERCISE MACHINE

[76] Inventor: Juris Terauds, 1501 W. Lake St., Fort Collins, Colo. 80521

[21] Appl. No.: 890,689

[22] Filed: May 29, 1992

[51] Int. Cl.[5] ..... A63B 22/04

[52] U.S. Cl. ..... 482/53; 482/80

[58] Field of Search ..... 482/79, 80, 53, 51, 482/52

[56] References Cited

U.S. PATENT DOCUMENTS

| | | | |
|---|---|---|---|
| 4,159,111 | 6/1979 | Lowth | 272/96 |
| 4,563,001 | 1/1986 | Terauds | 482/53 |
| 5,040,786 | 8/1991 | Jou | 482/52 |
| 5,062,627 | 11/1991 | Bingham | 482/53 |

FOREIGN PATENT DOCUMENTS

| | | | |
|---|---|---|---|
| 9102566 | 3/1991 | World Int. Prop. O. | 482/53 |

*Primary Examiner*—Stephen R. Crow

*Attorney, Agent, or Firm*—Sheridan Ross & McIntosh

[57] ABSTRACT

An exercise machine is provided that includes two stepping platforms pivotally interconnected to a frame. The stepping platforms are moved in a substantially vertical direction by the application of forces during the stepping motion by the user. The applied forces are resisted by fluidic cylinders. A rocker assembly is used to raise one of the stepping platforms while the other stepping platform is moved downwardly. A pair of lifter elements interconnects the stepping platforms with the rocker assembly. The ends of the lifter elements pivotally move during the vertical movement of the stepping platforms. Preferably, the pair of lifter elements is replaceable by another pair of lifter elements having a different length for use in varying the range of vertical movement of the stepping platforms. The stepping platforms are of a size to allow the user to vary the force required to cause vertical movement of the stepping platforms.

9 Claims, 5 Drawing Sheets

STEPPING EXERCISE MACHINE

FIELD OF THE INVENTION

The present invention relates to exercising apparatuses and, in particular, to a stepping exercise machine having a rocker assembly.

BACKGROUND OF THE INVENTION

Because labor saving devices have both substantially decreased the physical activity required by individuals and provided more recreational time, health-related exercise devices for realizing safe, enjoyable physical exercise have been developed. These exercisers are intended to achieve or include at least some of the following benefits: (i) large skeletal muscle development such as leg muscles; (ii) variable resistance responsive to the strength of the user; (iii) adjustability such that both the amount of resistance and the range of motion can be tailored to substantially all users; (iv) training capability for strength, endurance and/or cardiovascular conditioning; (v) compatibility with the mechanical movements of the human body; and (vi) durability, portability and relatively inexpensive to manufacture and assemble.

These worthwhile advantages are found to some extent in the following prior art stepping exercisers. In U.S. Pat. No. 3,295,847 issued to Matt, a portable stepping exerciser is disclosed that uses springs for resistance and is integral with its own carrying case. In U.S. Pat. No. 3,511,500 issued to Dunn, a stepping exerciser is disclosed that has a center pivot about which two foot pedals reciprocate in see-saw or rocking fashion. In U.S. Pat. No. 3,792,860 issued to Setnes, a stepping exerciser is disclosed that has a central inclined support between two foot platforms such that a crossbar pivots in see-saw fashion upon the end of the support projecting away from the floor. The crossbar is attached to the foot platforms such that the crossbar provides a mechanism for reciprocating the foot platforms. In U.S. Pat. No. 4,563,001 issued to the inventor of the exerciser disclosed herein, a stepping and arm exerciser is disclosed in which foot pedals reciprocate to each other and via the action of arm-manipulated levers.

Despite the large number of stepping exercise machines that have been proposed or devised, it would be worthwhile to provide a machine that incorporates more of the foregoing identified benefits in a single exercise machine.

SUMMARY OF THE INVENTION

The present invention relates to an exerciser for the legs that is suitable for physical fitness, rehabilitation, and athletic training and conditioning for cardiovascular or strength development. The stepping exerciser of the present invention is compact and light-weight so that it can be easily carried single-handedly or in a small suitcase.

The stepping exerciser includes first and second substantially parallel side-by-side foot platforms. Each platform includes an elongated stepping plate adapted to receive the foot of the user. The platform also includes a connector bar attached to the stepping plate and having one end pivotally attached to a cylindrical first cross-member. This first cross-member is journaled to the front section of a frame of the stepping exerciser. The platforms pivot in only a substantially vertical direction when the user applies forces thereto by means of a stepping action on the stepping plates. Thus, no lateral movement is required when using the exerciser. Each platform is attached to a hydraulic or pneumatic cylinder resistance pump or unit in order to provide a smooth variable resistance to the downward motion applied to the stepping plates during the stepping motion of the user.

The stepping exerciser also includes a rocker arm assembly pivotally attached to a second cross-member unit. The rocker assembly includes a pivot pin located midway between and below the platforms. The pivot pin pivotally interconnects the second cross-member unit and a rocker body of the rocker assembly.

The stepping exerciser further includes a pair of lifter elements. The lifter elements provide the force-exerting connection between the ends of the rocker body and the connector bars of the platforms. That is, a downward force on a first stepping plate against the resistance of the first pump causes an upward force to be transmitted, via the lifter element interconnection between the rocker body and the associated connector bar, to the second platform. In connection with the transmission of motion, the ends of the lifter elements pivot or rock in recesses or contact sections formed in the connector bars and the rocker body. By this movement, the substantially downward vertical movement of the platforms can be used to cause rocker motion of the rocker body in a plane substantially perpendicular to the plane of motion of the platform.

The stepping exerciser preferably includes a number of pairs of lifter elements, which may or may not be adjustable in length, with each pair having different heights. By inserting different height lifter elements between the platforms and the ends of the rocker assembly, or by adjusting the length of the lifter elements, the range of the stepping motion can be varied or adjusted and, concomitantly, the work required to move or reciprocate the stepping plates can be changed.

The resistance to be overcome during the stepping motion is also varied using the positions of the user's feet on the stepping plates. The closer the user's feet are positioned to the front of the stepping plates the more resistance is encountered. Conversely, the further the feet are located toward the back of the stepping plates, the less resistance is encountered.

Based on the foregoing summary, a number of salient features of the present invention are readily discerned. A portable and compact stepping exercise machine is provided for easy use, storage and carrying. The machine is characterized by a relatively few number of parts and the lack of lengthy interconnecting cables. In that regard, the exerciser includes relatively short lifter elements for providing the interconnection between stepping members and a rocker assembly. Preferably, a number of pairs of lifter elements, or adjustable lifter elements, are provided for use in varying the range of the stepping motion. Such lifter elements, together with the positioning of the user's feet on the platforms, enable the user to vary the resistance experienced during the stepping exercise.

Additional advantages of the present invention will become readily apparent from the following discussion, particularly when taken together with the accompanying drawings.

DETAILED DESCRIPTION

Figure 1:
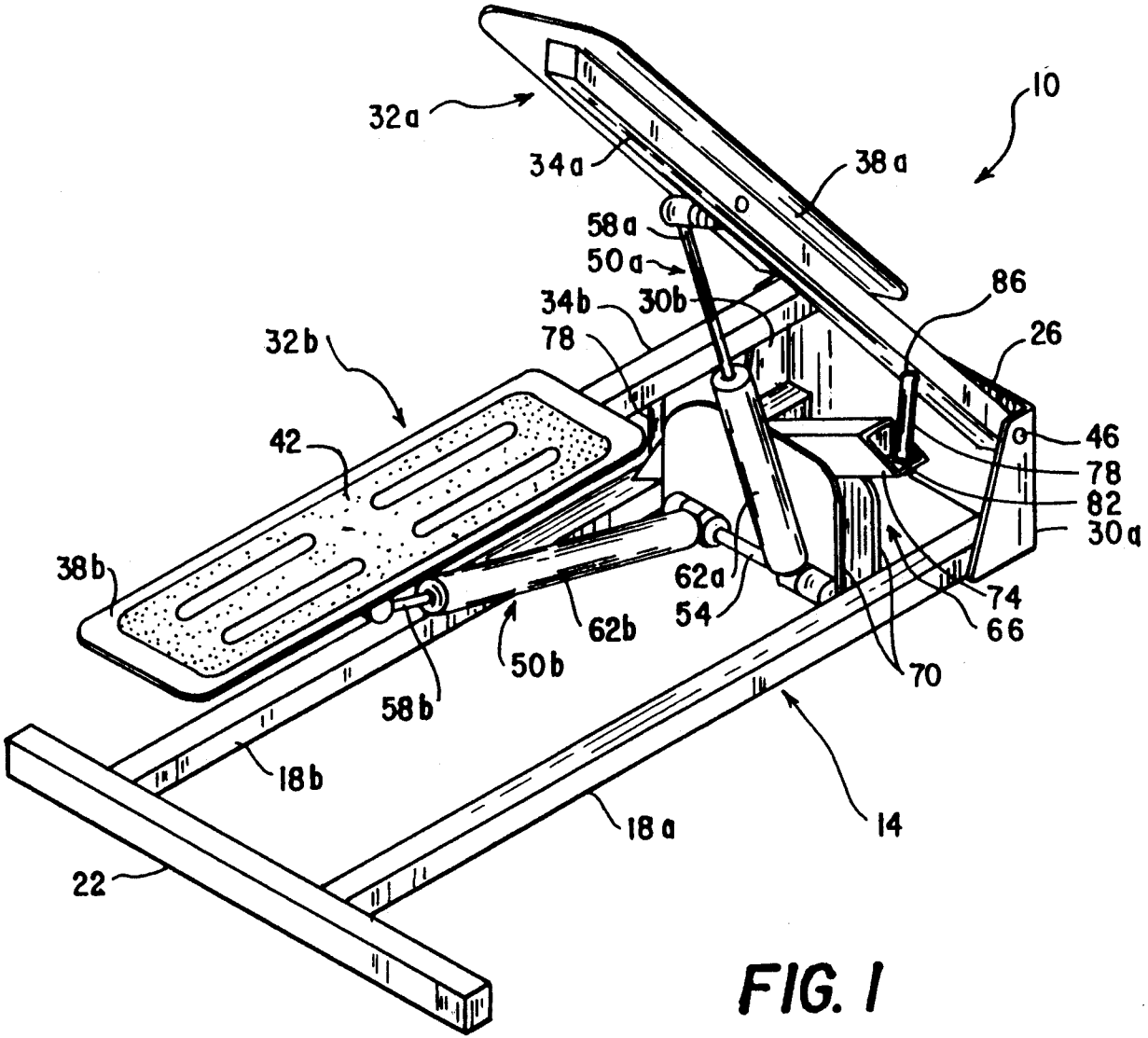
FIG. 1 is a perspective view of the stepping exercise machine of the present invention.
Figure 2:
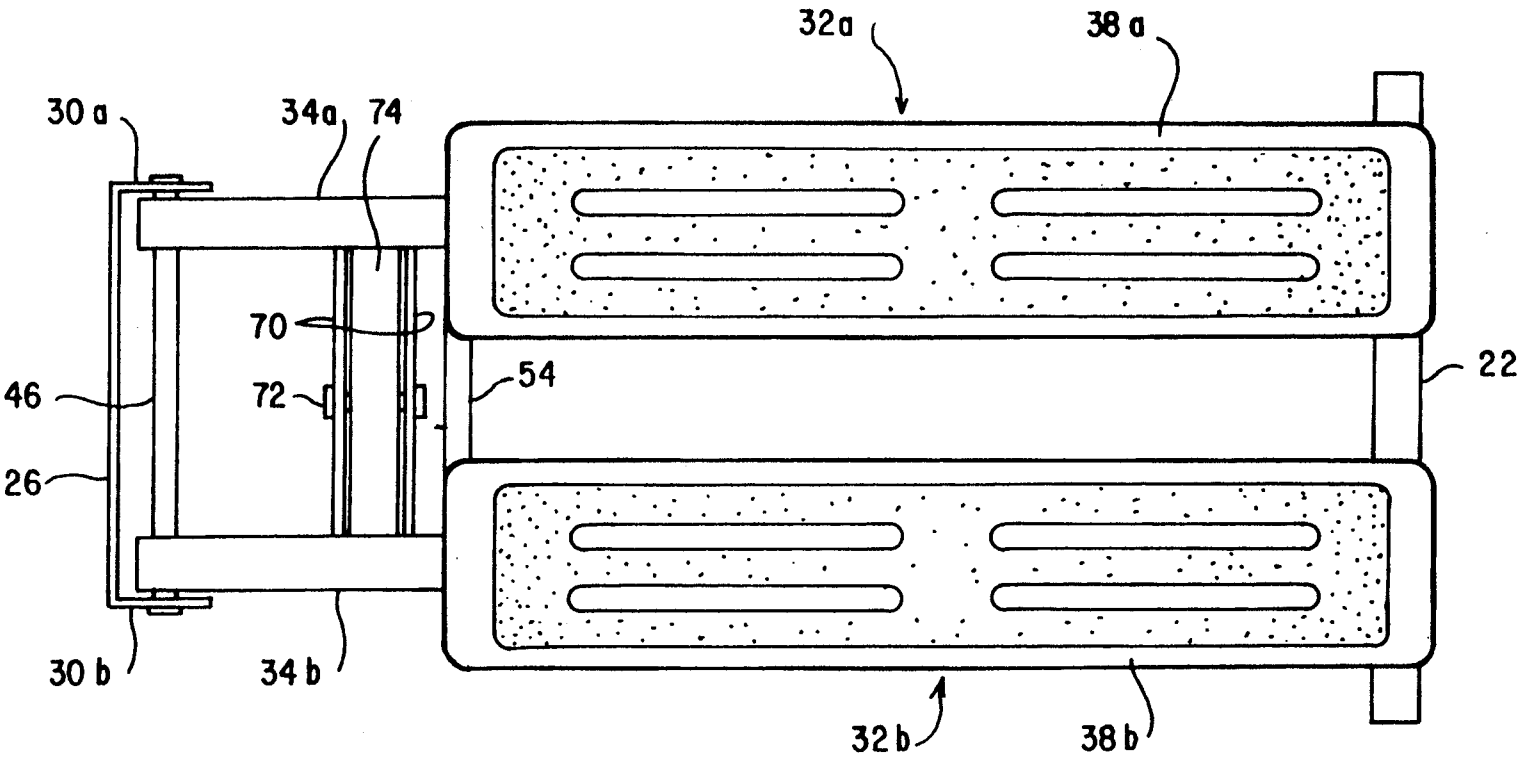
FIG. 2 is a top plan view thereof.

With reference to FIGS. 1 and 2, a stepping exerciser 10 is illustrated. The exerciser 10 includes a support frame 14 having two parallel lengthwise supports 18*a*, 18*b* which are on or near the floor and a rear cross-member support 22 firmly attached to the ends of supports 18*a*, 18*b* such that supports 18, 22 provide sufficient longitudinal and lateral stability for the exerciser 10 to remain upright during use. The frame support 14 also includes a front plate 26 which is not only firmly attached to supports 18*a*, 18*b* but also wraps around their front ends with vertical flanges 30*a*, 30*b*.

Above the support frame 14 are two platforms 32*a*, 32*b*. Each platform 32 includes a connector bar 34 and an attached stepping plate 38 upon which a user steps when using the exerciser 10. The top side of each stepping plate 38 has a non-slip surface 42 patterned upon it. An end of each connector bar 34 is attached at right angles to a front horizontally extending cross-member 46. The cross-member 46 is attached to the flanges 30. By this connection, the platforms 32 can pivot relative to the front cross-member 46 in two vertically spaced apart parallel planes.

For each connector bar 34*a*, 34*b* there is also, respectively, a hydraulic or pneumatic resistance unit or pump 50*a*, 50*b* attached thereto. Each pump 50 is pivotally attached to a pump attachment cross-member 54 which, in turn, is attached at its ends to the supports 18. Pumps 50 provide substantial resistance only during compression of rods 58 into cylinders 62 in a manner well known in the art. Moreover, the resistive force generated upon compression of a pump 50 is smooth and varies with the compression force. Thus, any downward force applied to a stepping plate 38 will be met with a related opposing resistive force resulting from the compression of the pump 50 attached to the connector bar 34 that is also connected to its particular stepping plate 38.

Figure 3:
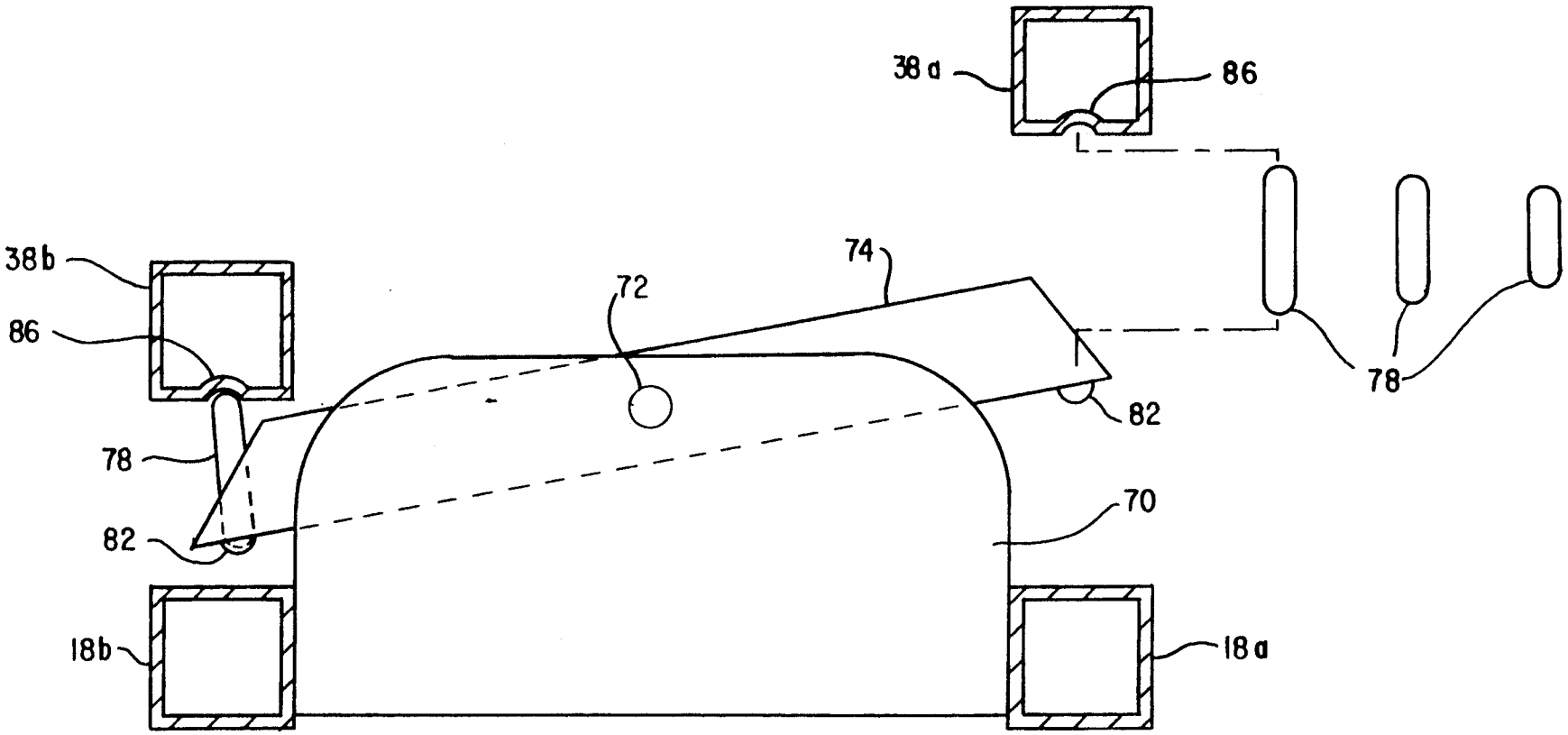
FIG. 3 is a front elevational view of the exercise machine schematically illustrating the movement of a lifter element and also illustrating a number of lifter elements different in height.
Figure 4:
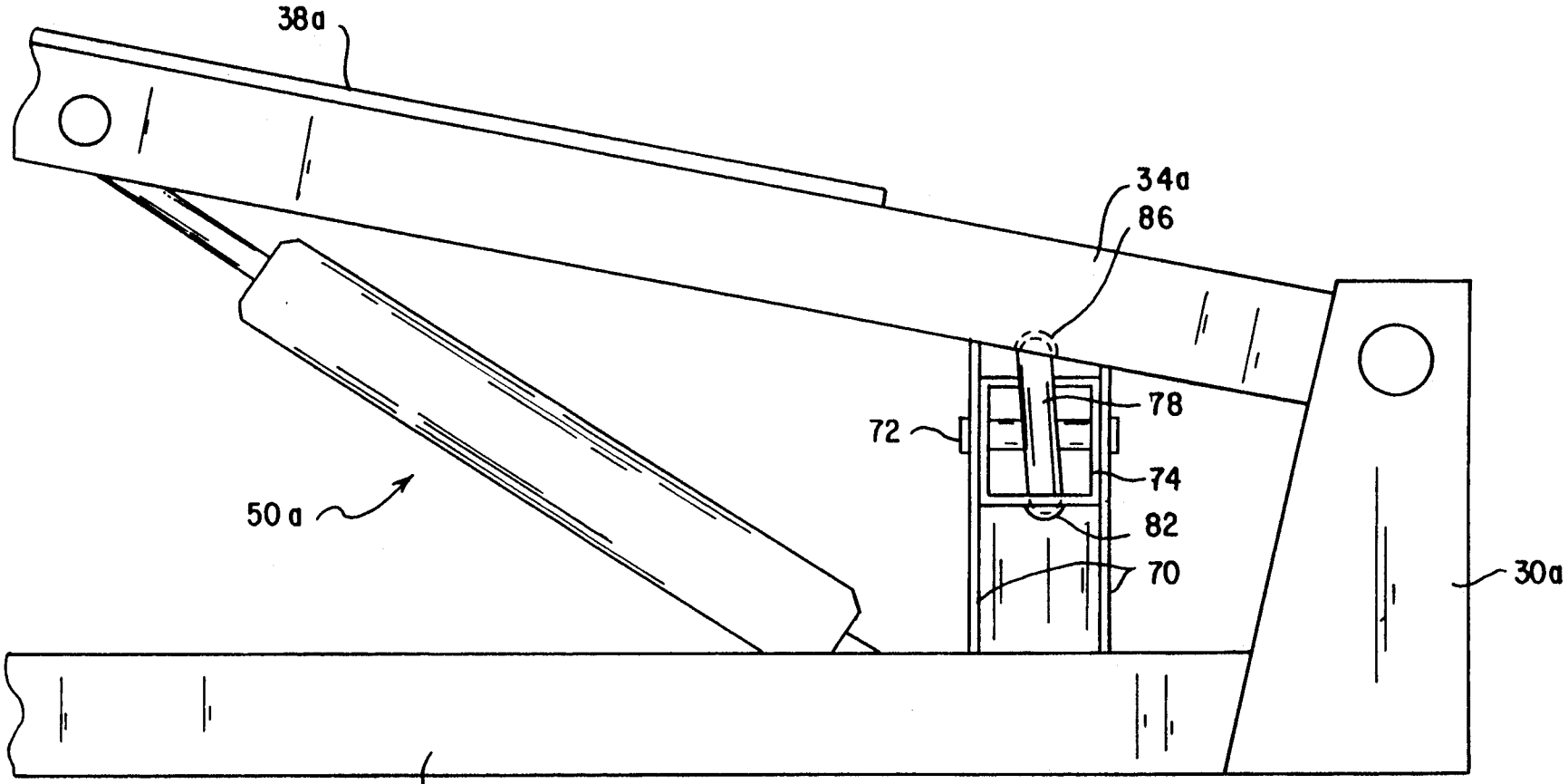
FIG. 4 is a side elevational view of the exercise machine also illustrating movement of the lifter element relative to the platform and rocker assembly.

In order to coordinate the alternating raising and lowering of the stepping plates 38, a rocker assembly 66 and accompanying lifter elements 78 are provided. As also illustrated in FIGS. 3 and 4, the rocker assembly 66 includes two parallel spaced apart cross-member stays 70 which are firmly attached at right angles to the supports 18. Between the stays 70, the rocker assembly 66 also includes a rocker body 74 which is pivotally attached to the stays 70 midway between the platforms 32 using a pivot pin 72. At the ends of the rocker body 74 there is a substantially hemispherical lifter contact section or recess 82 where a removable, generally cylindrical, lifter element 78 engages or is operably connected to the rocker body 74. Each lifter element 78 also engages a connector bar 34 in a substantially hemispherical lifter contact section or recess 86. The ends of all lifters 78 have substantially the same convex hemispherical shape such that any lifter end will substantially mate or engage with any contact section 82, 86. The lifter elements 78 generally pivot or rock in the recesses 82, 86 during their up/down movement with the platforms 32, as will be discussed in more detail below. A downward force on a raised platform 32 (e.g., 32*a*, FIG. 1) is communicated, via the contacting lifter element 78, to the rocker body 74. This results in an upward force being applied to the other platform 32 via its contacting lifter element 78.

In using the stepping exerciser 10, the user places the exerciser 10 on a generally level floor and determines the range of resistive motion desired. The greater the range of motion, the greater the differential between a fully raised and fully lowered platform 32. To vary the stepping motion differential, a plurality of varying height lifter element 78 pairs are preferably usable as part of the exerciser 10. In one embodiment, three pairs of lifter elements 78 are provided whose relative heights are depicted in FIG. 3. The stepping motion differential can be increased by using longer lifter elements 78 since the platform 32 to which it is operably connected is able to move in a greater up/down or vertical path.

Once the desired length of lifter elements 78 has been selected by the user, the chosen lifter elements 78 can be positioned between the contact sections 82, 86 by manually raising each platform 32 and/or lowering the rocker body 74 on the same side so that the selected lifter elements 78 can be inserted. After selected lifter elements 78 have been positioned between both contact sections 82, 86, the user may then position himself/herself on the stepping plates 38 while facing the front of the exerciser 10, preferably with the stepping plates 38 substantially at the same height. Subsequently, the user shifts his/her weight alternatingly from one leg to the other in a stepping motion. When the downward force differential between a stepping plate 38 is sufficiently greater than the resistance of its connected pump 50 such that the friction of the various moving parts (including extension of the other pump 50) is overcome, the stepping plate 38*a* or 38*b* will be lowered and the other stepping plate 38*b* or 38*a* will be raised.

As the stepping plates 38 reciprocate or move in a substantially vertical direction, each lifter element 78 pivots or rocks in its associated recess or contacting section 82, 86. During this movement, the lifter elements 78 are somewhat off set from vertical, as seen in FIGS. 3 and 4. This movement is comparable to ball-/socket movement and occurs on both ends of the lifter elements 78 during the up/down movement of the stepping plates 38 and the pivoting motion of the rocker body 74. By means of the pivoting or rocking motion of the lifter element ends, a desired height or vertical range of motion of the stepping plates 38 can be achieved while providing the necessary connection between the stepping plates 38 and the pivoting rocker body 74. If the lifter elements 78 were fixedly held to either the rocker body 74 or a connector bar 34, lateral stresses would be produced causing the lifter element to jump or bind. This would result in a rougher movement of the stepping plates and the rocker body, with undue friction and wear.

Figure 5:
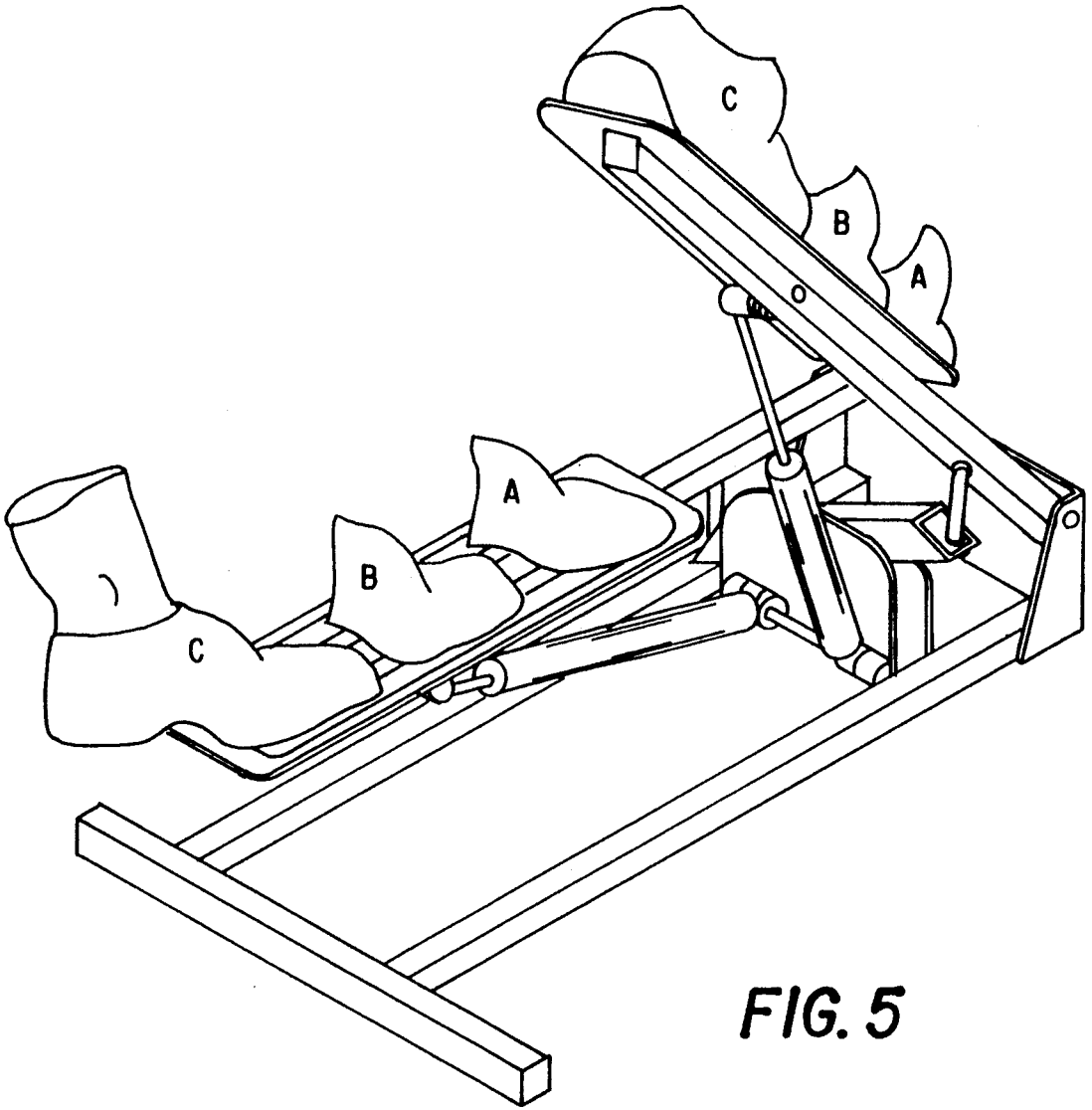
FIG. 5 is a perspective view of the stepping exercise machine illustrating different positions of the user's feet on the platforms.

If more resistance to the stepping action is desired from the exerciser 10, this can be accomplished in one or both of two ways. First, the closer the user's foot is to the front of the stepping plate 38, the more strength or force is required to move the stepping plate 38 downward. As illustrated in FIG. 5, foot position A requires more force to lower the stepping plates 38 than does foot position B. Similarly, foot position C requires even less force. Secondly, since the pumps 50 provide greater resistance as more downward force is applied to the stepping plates 38, the speed and the amount of weight which the user transfers between a raised and lowered stepping plate 38 can also vary the resistance.

Although the preferred embodiment disclosed involves the use of different pairs of lifter elements that vary in length, it should be appreciated that a single pair of lifter elements could be employed, with each of the two such lifter elements being adjustable to different heights. Relatedly, it is not necessary that removable or adjustable lifter elements be employed. The present invention could incorporate a fixed connection between the platforms and the rocker assembly to achieve a predetermined range of motion. It should also be understood that the stepping plates of the present invention need not be of a size to accommodate different positions of the user's feet for use in varying the force required to overcome the resistance associated with the stepping plates. Instead, a smaller sized platform could be employed which does not necessarily permit different positions of the user's feet.

In view of the foregoing detailed description, a number of advantages of the present invention should be immediately recognized. A stepping exerciser is provided that allows the user to achieve desired exercise at a convenient time and location, including at home or at the user's workplace. The exerciser is portable and lightweight for easy carrying and is compact to facilitate storage thereof. The exerciser has a reduced number of parts. The range of stepping motion is preferably adjustable using lifter elements that achieve a desired interconnection between the vertical movement of stepping members and the pivoting movement of a rocker. The stepping members for receiving the user's feet are preferably of a size to permit the resistive force experienced by the user to be varied. The stepping exerciser is also relatively inexpensive, easy to manufacture and assemble and does not require lengthy or complicated interconnecting cables.

The foregoing discussion of the invention has been presented for purposes of illustration and description. Further, the description is not intended to limit the invention to the form disclosed herein. Subsequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or other embodiments, and with the various modifications required by their particular application or uses of the invention. It is intended that the appended claims be construed to include alternative embodiments to the extent permitted by the prior art.

I claim:

1. A stepping exercise apparatus, comprising:

stepping means for moving upon application of a force by the user of the apparatus, said stepping means including a first connector bar;

force resistance means connected to said stepping means;

frame means connected to said stepping means, said frame means including first cross-member means and said first connector bar being pivotally connected to said first cross-member means;

rocker means positioned below said stepping means, said rocker means moving along a path different from said stepping means, said rocker means including second cross-member means, a rocker body and a pivot pin with said rocker body being pivotally connected to said second cross-member means using said pivot pin and said frame means including means for pivotal attachment to said force resistance means; and means for interconnecting said rocker means and said stepping means, said means for interconnecting including a ball and socket device comprising a first mating section and a first lifter element having a first mating end, with a majority of said first lifter element being exposed and said first mating end contacting said first mating section, a maximum width of said first mating end being substantially no greater than widths of remaining portions of said first lifter element.

2. An apparatus, as claimed in claim 1, wherein:

said stepping means includes a first connector bar pivotally connected to said frame means.

3. An apparatus, as claimed in claim 1, wherein:

said stepping means includes first and second stepping plates and a second connector bar, with each of said first and second connector bars extending beyond each of said first and second stepping plates for pivotal connection to said frame means.

4. An apparatus, as claimed in claim 1, wherein:

said force resistance means includes a first cylinder and a first rod, said first rod being connected to said stepping means and said cylinder being pivotally connected to said frame means.

5. An apparatus, as claimed in claim 4, wherein:

said cylinder is connected to said frame means adjacent to said rocker means and said first rod is connected adjacent an end of said stepping means.

6. An apparatus, as claimed in claim 1, wherein:

said stepping means includes first and second stepping plates and said pivot pin is located substantially midway between said first and second stepping plates.

7. An apparatus, as claimed in claim 1, wherein:

said first lifter element is removable from between said stepping means and said rocker means, wherein a distance moved by said stepping means between fully raised and fully lowered positions thereof is variable.

8. An apparatus, as claimed in claim 1, wherein:

said first mating section includes a first recess formed in said rocker means, a first contact section formed in said first connector bar and said first lifter element being disposed in said first recess and said first contact section.

9. An apparatus, as claimed in claim 8, wherein:

said first mating end of said first lifter element is substantially hemispherical in shape.

* * * * *